United States Patent [19]

Timari

[11] 4,454,672

[45] Jun. 19, 1984

[54] LOCK MEANS

[76] Inventor: Jali Timari, Hatanpäänvaltatie 32, 33100 Tampere 10, Finland

[21] Appl. No.: 347,186

[22] Filed: Feb. 9, 1982

[30] Foreign Application Priority Data

Feb. 13, 1981 [FI] Finland ..... 810462

[51] Int. Cl.[3] ..... F41C 11/00

[52] U.S. Cl. ..... 42/16

[58] Field of Search ..... 42/16, 76 A

[56] References Cited

U.S. PATENT DOCUMENTS

| | | | |
|---|---|---|---|
| 1,291,689 | 1/1919 | Sheppard | 42/16 |
| 1,413,109 | 4/1922 | Feederle | 42/16 |
| 1,830,989 | 11/1931 | Faure | 42/16 |
| 2,736,117 | 2/1956 | Clarkson et al. | 42/76 A |

*Primary Examiner*—Charles T. Jordan
*Assistant Examiner*—Ted L. Parr

[57] ABSTRACT

The invention concerns a lock means comprising a lock bolt (1) and a lock frame (3). The lock bolt comprises a crank (2), a closing shoulder (4) for securing to be held by a mating shoulder (27) on the lock frame, and a striking pin (5) with spring (6), and cocking body (7). The object is to provide a new lock means of which the design makes possible its easy and inexpensive manufacturing and accurate fitting into the lock frame. A further object is to provide a crank lock and lock frame which is reliable in service, accurate and inexpensive.

The lock means in characterized in that the lock comprises a guide tube (11) which constitutes the outer cover for the lock bolt (1). The guide tube is rotatable with reference to the lock bolt (1). The shape of the inner surface (12) of the lock frame (3) conforms in its cross section to the guide tube, and the tube cannot be evaded with reference of the lock frame. The guide tube is profitable at least plastic-coated, preferably made mainly of plastic in its entirety.

6 Claims, 4 Drawing Figures

LOCK MEANS

The present invention concerns a lock means for a rifle.

BACKGROUND OF THE INVENTION

Substantially important in view of the operation of the lock is the mainly free mobility of the lock in its longitudinal direction and its rotary motion about its longitudinal axis in the course of the lock's opening and closing motions. If the fit of the lock is too loose, this causes a rough, clanking and binding reciprocating motion of the lock, which gives rise to malfunctions when the lock is operated rapidly. Excessively tight fit prevents or hampers the unrestricted action of the lock. Accurate and exact fitting of the lock in the lock frame constitutes the basis for the fire arm's reliability in service and its accuracy.

The crank locks known in the art are made of steel. The combination of the difficult machinability of a material presenting adequate strength characteristics and of the narrow and exact dimensional tolerances implied by the dimensioning of the lock and by its fitting into the lock frame results in high manufacturing costs of the crank lock. The price of a high-class crank lock accounts for a remarkable share in the total price of the firearm.

SUMMARY OF THE INVENTION

The object of the present invention is to eliminate the drawbacks pointed out. In particular, it is an object of the invention to provide a rifle lock means of which the design makes possible an easy and inexpensive manufacturing process, while at the same time the lock can be accurately fitted into the lock frame. It is an especial object of the invention to provide a reliably operating, accurate and inexpensive crack lock and frame. Moreover, the object of the invention is to teach a procedure for the manufacturing of the said crank lock.

Regarding the features which are characteristic of the invention, reference is made to the claim part of this application.

Thanks to the invention, the guide tube guiding the lock bolt in the lock frame is non-rotatable with reference to the lock frame. This is due to the cross sectional shape of the guide tube, with which conforms the shape of the lock frame's inner surface, and to the design of the guide tube and lock bolt which makes them substantially freely rotatable with reference to each other. Thanks to the invention, the longitudinal motion of the lock bolt, which is indispensable in view of the mode of operation of the crank lock, takes place exclusively as a longitudinal movement of the guide tube and lock frame, free of rotational movements, that is as a non-rotary movement with reference to each other; and the rotary movement takes place as a rotation of the lock bolt and the guide tube with reference to each other and about a common longitudinal axis, that is as a non-longitudinal movement with reference to each other. Hereby the guide tube can be fitted in the lock frame for longitudinal movement only, and the lock bolt can be fitted in the guide tube for rotary movement only.

The triangular shape of the cross section of the lock bolt guide tube and of the corresponding inner surface of the lock frame affords in this lock a guiding which is substantially superior to that in any other known lock embodiments. Thanks to the guide tube, a long and good guiding effect is achieved for the lock. The triangular shape of the lock frame endows the frame with better rigidity and stability, with less weight than in any lock designs of prior art. The triangular shape of the lock frame enables the frame to be made with a flat bottom, thereby gaining stable abutment surfaces for the stock fitting, and this is an absolute requirement for high accuracy of the gun, in particular if it is a contest shooting gun.

Thanks to the invention, it is now possible to make the guide tube, instead of the very high-grade steels known in the art, even of plastic, for instance by die casting. This implies substantially lower manufacturing costs compared with prior art. A guide tube for the lock bolt made by die casting of plastic has in actual use proved to be superior to one of steel. The resilient plastic surface makes the lock run smoothly and elastically, and at the same time with a feel of accuracy and good fitting, thus making the lock pleasant to use. Through the procedure of making the guide tube of plastic, the mass to be moved has been reduced, and likewise the weight of the entire lock.

The design of the crank lock and lock frame of the invention and their manufacturing, and the advantages gainable by the aid of the invention, are described in the following in detail with the aid of embodiment examples, with reference to the attached drawing, wherein:

DESCRIPTION OF THE ILLUSTRATED EMBODIMENT

Figure 1:
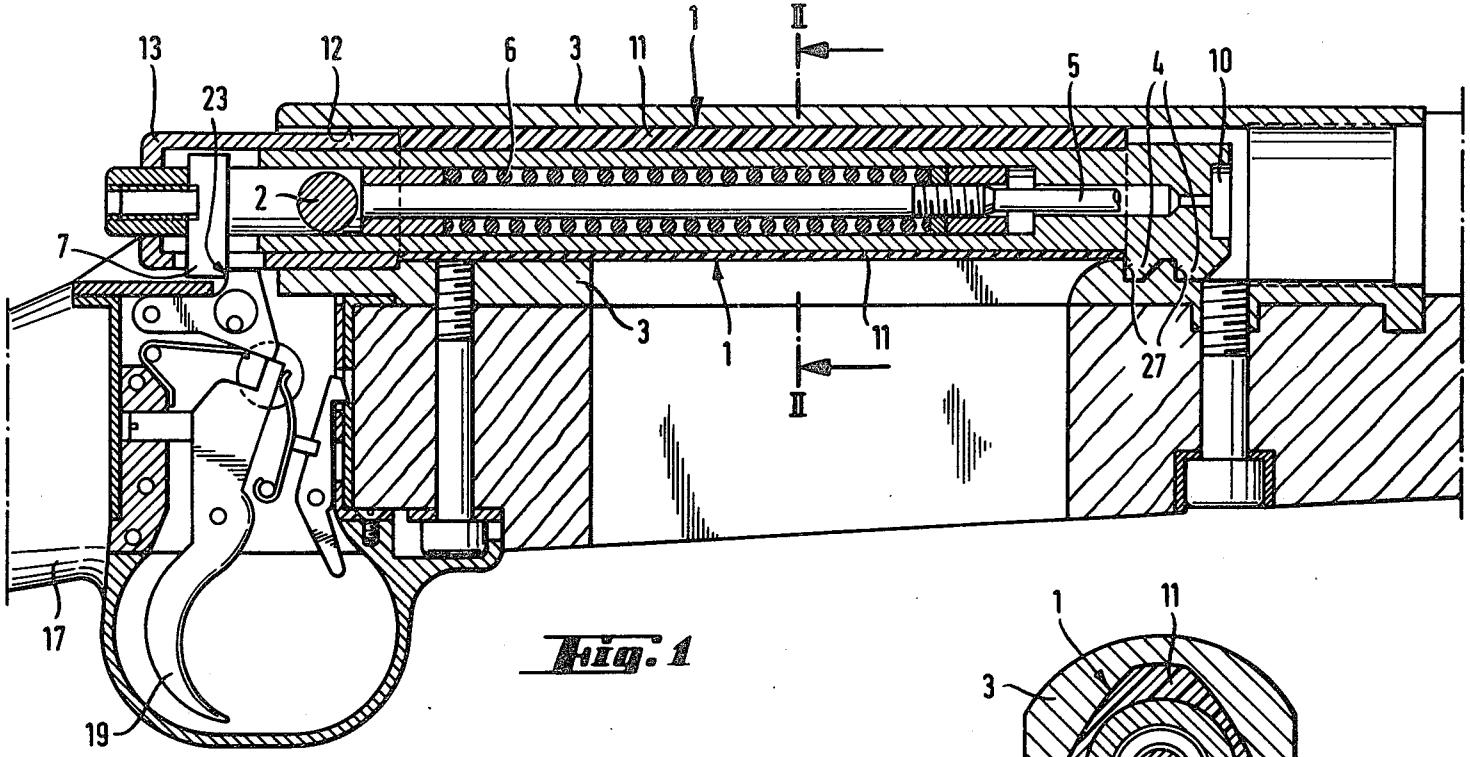
FIG. 1 presents the crank lock and lock frame of the invention, in elevational view and on section, mounted on the rifle.

In FIG. 1 can be seen a rifle crank lock and lock frame according to the invention, the parts of the rifle in front of and behind the lock having been omitted on the figure. The crank lock comprises a lock bolt 1 and a crank 2 (the crank is not visible in FIG. 1, but in FIG. 3), the latter allowing the lock bolt to be moved forward and backward and to be locked and released, carried by the lock frame 3. The lock bolt 1 further comprises three closing shoulders 4, the striking pin 5 with spring 6 and cocking body 7 for cocking and triggering the striking pin in cooperation with the firing mechanism, and an extractor (not visible in the figure) for removing the shell from the cartridge housing 10.

As taught by the invention, the lock comprises a guide tube 11 encircling the lock bolt 1, and which constitutes the outer cover for the lock bolt. The guide tube 11 is rotatable with reference to the lock bolt. The guide tube has a cross section of substantially triangular shape, as can be seen in the sectional view, FIG. 2, the shape of the inner surface 12 of the lock frame conforming to the shape of the guide tube as to its cross section. In the embodiment presented, the points and sides of the cross sectional triangle both of the guide tube 11 and the lock frame 3 have been rounded, and one side of the triangle is downward; the side 25 of the lock frame corresponding to the last-mentioned has been made flat for accurate fitting of the stock 17. The lock bolt 1 comprises a rear body 13, to which the crank 2 has been detachably attached, and of which the largest diameter is smaller than the largest diameter of the guide tube. The space which has been opened in the frame for the rear body does not extend past the points of the guide tube triangle in the transverse direction of the lock bolt, whereby the guiding effect is maintained all the way to the rear of the frame in the open position of the lock. The closing shoulders 4 have been disposed in the longitudinal direction of the lock in two consecutive planes, three shoulders in each and two shoulders after each other in the longitudinal direction of the lock bolt 1, that is six shoulders all told. The shape of the closing shoulders 4 in the section at right angles to the longitudinal axis of the lock bolt 1 conforms to the shape of the corresponding section of the inner surface 12 of the lock frame 3. On the lock frame, mating shoulders 27 have been formed to correspond to the lock bolt's closing shoulders 4 with an angular displacement of e.g. 45° to 60° from the points of the cross sectional triangle of the lock frame's inner surface 12.

To close the lock, the lock bolt is pushed by the crank 2 against the cartridge housing 10, whereby the front edge of the lock takes from the feeding means (not depicted) one cartridge and carries it into the cartridge housing. At the end of its rectilinear movement the crank 2 hits against a chamfer on the frame, and this chamfer forces the crank to turn downward while at same time the crank is also pressed down by hand, thus forcing the crank in behind the mating shoulders 27 of the lock frame. At the same time, the cocking body 7 on the striking pin remains resting on the cocking rest 23 in the firing mechanism, and the gun is ready to be fired. The trigger 19 is depressed to release the striking pin 5, which hits with its point on the cap, igniting it. After the round has been fired, the lock is opened by moving the crank 2 upward, thus releasing the locking between the closing shoulders 4 and the mating shoulders of the lock frame, and the lock may now be retracted.

Figure 3:
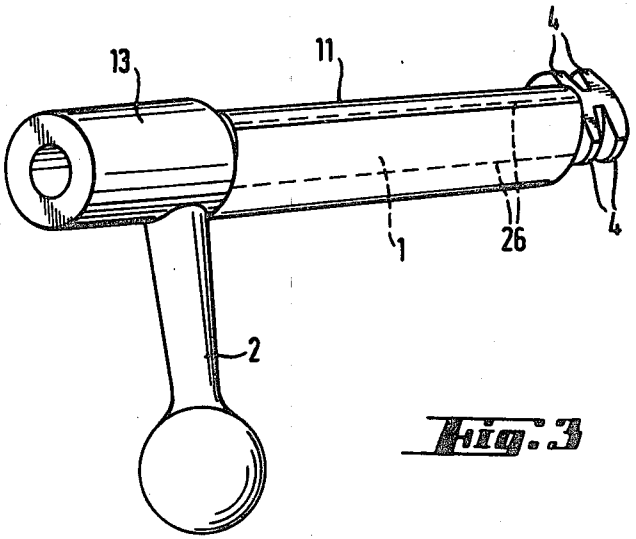
FIG. 3 shows the crank lock presented on FIG. 1, in perspective and viewed obliquely from the rear.
Figure 4:
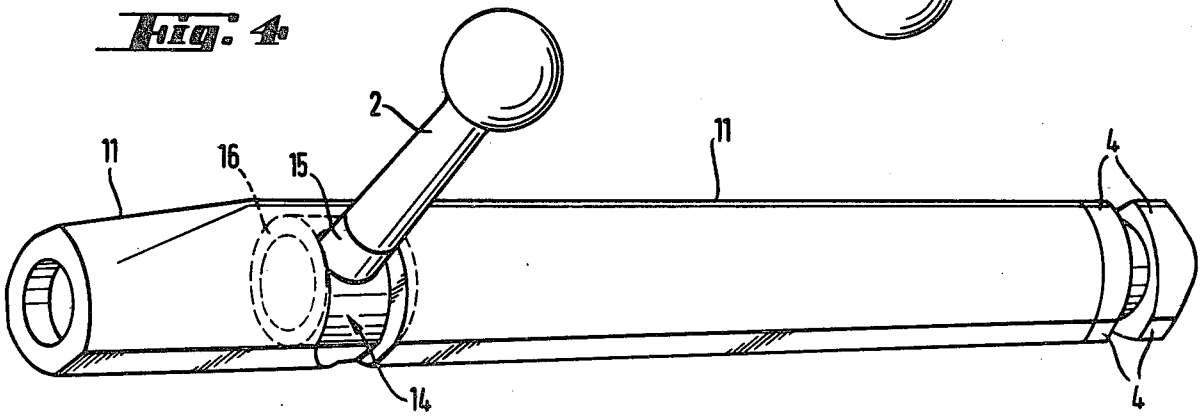
FIG. 4 presents another crank lock according to the invention, in perspective and viewed obliquely from the rear.

In FIG. 4 has been illustrated another crank lock according to the present invention, where the lock bolt 1 (hidden in the figure within the guide tube 11) has been disposed inside the guide tube 11, the closing shoulders 4 excepted. On the guide tube 11 an elongated aperture 14 has been formed on the tube's longitudinal direction, through which the crank 2 emerges and which allows the crank to turn transversally with reference to the lock bolt's longitudinal direction. In FIG. 4, the guide tube 11 of the crank lock is braced on its entire length by the lock frame, whereby a long and good guiding effect of the lock is obtained. Regarding the striking pin, spring and cocking body and the closing shoulders, the design of the lock shown in FIG. 4 is largely consistent with that of the lock of FIGS. 1–3.

Figure 2:
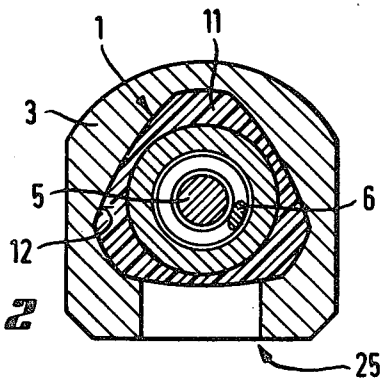
FIG. 2 shows the section along the line II—II in FIG. 1.

The guide tube on the lock which has been depicted in FIGS. 1–3 may consist e.g. of a metal tube which has been coated with plastic, such as with die-cast polyacetate, nylon, etc. The guide tube may be die cast altogether of plastic, to advantage. The crank lock guide tube 11 on FIG. 4 has been made substantially altogether of plastic by die-casting upon a mandrel. On the mandrel has been placed a metal ring 16 provided with a threaded sleeve 15, and space to move has been provided for the said ring, for the rotation about the longitudinal axis of the lock bolt. The lock bolt is connected e.g. with a crank pin or another equivalent element to the said ring 16. The crank 2 is screwed into the threaded sleeve 15.

The embodiment examples are meant to illustrate the invention, without in any way confining it. Embodiments of the invention may vary within the scope of the claims following below; for instance, the guide tube may be arranged to be movable e.g. a few millimeters on the longitudinal direction of the lock bolt. For material of the guide tube of the crank lock one may use, instead of acetal and nylon which were already mentioned, e.g. polycarbonate, polyester terephthalate or another material. The guide tube may naturally also be made of metal, such as steel, aluminium, etc. It should be noted that the lock means guide tube of the invention may be used in any bolt locks known in the art. The cross sectional shape of the guide tube, and also the corresponding inner surface of the lock frame, may differ from the triangle presented in the embodiments above. The guide tube and/or the lock frame may be cylindrical, it may have many angles (for example guadangular) or it may be shaped of different or similar shapes, for example a cylinder cut by at least one parallel plane.

I claim:

1. Lock means for a rifle, comprising a lock frame, a lock bolt carried by said lock frame and having a crank by the aid of which the lock bolt can be moved forward and rearward and locked and unlocked by rotating the lock bolt in said lock frame, said lock bolt including at least one closing shoulder for locking the lock bolt on the lock frame, a guide tube encircling said lock bolt and constituting an outer cover for the lock bolt, said guide tube being rotatable relative to the lock bolt and being non-rotatable relative to the lock frame, the inner surface of the lock frame having a non-circular cross sectional shape and the outer surface of the guide tube having a complementary non-circular shape.

2. Lock means according to claim 1, characterized in that the outer surface of said guide tube and the inner surface of said lock frame have a substantially triangular cross sectional shape, of which the triangle edges and sides are rounded, one side of the triangle in the cross section facing downward.

3. Lock means according to claim 2, characterized in that the lock means comprises at least three closing shoulders which in their cross section conform to the shape of the guide tube.

4. Lock means according to claim 2, characterized in that the lock bolt comprises a rear body to which said crank is connected, the largest diameter of said body being smaller than the largest diameter of the guide tube.

5. Lock means according to claim 4, characterized in that said outer surface of the guide tube is composed of plastic.

6. Lock means according to claim 2, characterized in that the lock bolt is disposed substantially within the guide tube, and the guide tube is provided with an elongated aperture to admit the movements of the crank in transverse direction to the tube.

* * * * *